US008579123B2

(12) United States Patent
Mueller et al.

(10) Patent No.: US 8,579,123 B2
(45) Date of Patent: Nov. 12, 2013

(54) MERCHANDISING SYSTEM

(75) Inventors: Paul A. Mueller, Wadsworth, OH (US); John Caterinacci, Hudson, OH (US); Gerald Szpak, North Royalton, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 113 days.

(21) Appl. No.: 13/239,084

(22) Filed: Sep. 21, 2011

(65) Prior Publication Data

US 2012/0006773 A1 Jan. 12, 2012

Related U.S. Application Data

(63) Continuation-in-part of application No. 11/809,862, filed on Jun. 1, 2007, now Pat. No. 8,177,076, which is a continuation-in-part of application No. 11/356,398, filed on Feb. 16, 2006, now Pat. No. 7,971,735.

(51) Int. Cl.
*A47F 1/04* (2006.01)

(52) U.S. Cl.
USPC ..... 211/59.3

(58) Field of Classification Search
USPC ..... 211/59.2, 59.3, 189, 184, 175; 312/61, 312/71; 221/227, 255, 279
See application file for complete search history.

(56) References Cited

U.S. PATENT DOCUMENTS

| | | | | |
|---|---|---|---|---|
| 1,971,749 | A | | 8/1934 | Hamilton |
| 2,079,754 | A | | 5/1937 | Waxgiser |
| 2,652,154 | A | | 9/1953 | Stevens |
| 2,678,045 | A | | 5/1954 | Erhard |
| 2,884,139 | A | * | 4/1959 | Dunham ..... 211/184 |
| 3,038,067 | A | | 6/1962 | Dench et al. |
| 3,161,295 | A | | 12/1964 | Chesley |
| 3,308,961 | A | | 3/1967 | Chesley |
| 3,452,899 | A | | 7/1969 | Libberton |
| 3,501,019 | A | * | 3/1970 | Armstrong et al. ..... 211/184 |
| 3,703,964 | A | * | 11/1972 | Field ..... 211/184 |
| 3,751,129 | A | | 8/1973 | Wright et al. |
| 3,814,490 | A | | 6/1974 | Dean et al. |
| 3,868,021 | A | | 2/1975 | Heinrich |
| 4,042,096 | A | | 8/1977 | Smith |

(Continued)

FOREIGN PATENT DOCUMENTS

| | | |
|---|---|---|
| CH | 412251 | 4/1966 |
| DE | 28 25 724 | 12/1979 |

(Continued)

OTHER PUBLICATIONS

FFr Yellow Pages® 2003 Product Catalog, "Merchandising Ideas Made Easy For Every Retail Environment!", Cover pg., 9-11, 48-49, 52-58, Back Cover.

*Primary Examiner* — Jennifer E Novosad
(74) *Attorney, Agent, or Firm* — Fay Sharpe LLP

(57) ABSTRACT

A merchandising system includes an elongated mounting member that is selectively securable to a front portion of an associated shelf. A cooperating member is received on the mounting member. The cooperating member extends rearwardly over the associated shelf. The cooperating member includes an elongated body having a front end and a rear end and a nose extending from the front end. A hinge connects the nose to the front end. The nose contacts a wall of the elongated mounting member to retard relative movement between the cooperating member and the elongated mounting member.

20 Claims, 9 Drawing Sheets

(56) References Cited

U.S. PATENT DOCUMENTS

| | | | | | |
|---|---|---|---|---|---|
| 4,106,668 | A | | 8/1978 | Gebhardt et al. | |
| 4,269,326 | A | | 5/1981 | Delbrouck | |
| 4,303,162 | A | | 12/1981 | Suttles | |
| 4,351,439 | A | | 9/1982 | Taylor | |
| 4,378,872 | A | | 4/1983 | Brown | |
| 4,395,955 | A | * | 8/1983 | Pfeifer | 108/61 |
| 4,476,985 | A | * | 10/1984 | Norberg et al. | 211/133.6 |
| 4,488,653 | A | * | 12/1984 | Belokin | 211/184 |
| 4,615,276 | A | * | 10/1986 | Garabedian | 108/61 |
| 4,712,694 | A | * | 12/1987 | Breslow | 211/184 |
| 4,724,968 | A | | 2/1988 | Wombacher | |
| 4,730,741 | A | | 3/1988 | Jackle, III et al. | |
| 4,735,324 | A | * | 4/1988 | Wilcek | 211/184 |
| 4,762,236 | A | | 8/1988 | Jackle, III et al. | |
| 4,775,058 | A | * | 10/1988 | Yatsko | 211/184 |
| 4,830,201 | A | | 5/1989 | Breslow | |
| 4,907,707 | A | | 3/1990 | Crum | |
| 5,072,835 | A | * | 12/1991 | Price et al. | 211/40 |
| 5,111,942 | A | | 5/1992 | Bernardin | |
| 5,161,704 | A | | 11/1992 | Valiulis | |
| 5,190,186 | A | | 3/1993 | Yablans et al. | |
| 5,203,463 | A | | 4/1993 | Gold | |
| 5,217,124 | A | * | 6/1993 | Stone | 211/184 |
| 5,255,802 | A | | 10/1993 | Krinke et al. | |
| 5,275,297 | A | * | 1/1994 | Dokoupil et al. | 211/184 |
| 5,325,792 | A | | 7/1994 | Mulloy | |
| 5,341,945 | A | * | 8/1994 | Gibson | 211/184 |
| 5,351,839 | A | | 10/1994 | Beeler et al. | |
| 5,390,802 | A | | 2/1995 | Pappagello et al. | |
| 5,450,969 | A | | 9/1995 | Johnson et al. | |
| 5,464,105 | A | * | 11/1995 | Mandeltort | 211/184 |
| 5,469,976 | A | | 11/1995 | Burchell | |
| 5,562,217 | A | | 10/1996 | Salverson et al. | |
| 5,582,305 | A | * | 12/1996 | Howell et al. | 211/126.1 |
| 5,634,564 | A | | 6/1997 | Spamer et al. | |
| 5,638,963 | A | | 6/1997 | Finnelly et al. | |
| 5,665,304 | A | | 9/1997 | Heinen et al. | |
| 5,673,801 | A | * | 10/1997 | Markson | 211/59.3 |
| 5,682,824 | A | * | 11/1997 | Visk | 108/60 |
| 5,746,328 | A | | 5/1998 | Beeler et al. | |
| 5,839,588 | A | | 11/1998 | Hawkinson | |
| 5,884,782 | A | * | 3/1999 | Dembicks | 211/70.6 |
| 5,971,173 | A | * | 10/1999 | Valiulis et al. | 211/184 |
| 6,041,720 | A | * | 3/2000 | Hardy | 108/60 |
| 6,082,557 | A | | 7/2000 | Leahy | |
| 6,129,218 | A | | 10/2000 | Henry et al. | |
| 6,142,317 | A | | 11/2000 | Merl | |
| 6,227,385 | B1 | | 5/2001 | Nickerson | |
| 6,227,513 | B1 | | 5/2001 | Richard | |
| 6,234,328 | B1 | | 5/2001 | Mason | |
| D445,615 | S | | 7/2001 | Burke | |
| 6,299,004 | B1 | * | 10/2001 | Thalenfeld et al. | 211/184 |
| 6,382,431 | B1 | | 5/2002 | Burke | |
| 6,409,027 | B1 | | 6/2002 | Chang et al. | |
| 6,409,028 | B2 | | 6/2002 | Nickerson | |
| 6,464,089 | B1 | | 10/2002 | Rankin, VI | |
| 6,484,891 | B2 | | 11/2002 | Burke | |
| 6,527,127 | B2 | | 3/2003 | Dumontet | |
| 6,533,131 | B2 | * | 3/2003 | Bada | 211/59.2 |
| D472,411 | S | | 4/2003 | Burke | |
| 6,598,754 | B2 | | 7/2003 | Weiler | |
| 6,622,874 | B1 | | 9/2003 | Hawkinson | |
| 6,648,151 | B2 | * | 11/2003 | Battaglia et al. | 211/59.2 |
| 6,655,536 | B2 | | 12/2003 | Jo et al. | |
| 6,666,533 | B1 | | 12/2003 | Stavros | |
| D485,699 | S | | 1/2004 | Mueller et al. | |
| 6,772,888 | B2 | | 8/2004 | Burke | |
| 6,796,445 | B2 | * | 9/2004 | Cyrluk | 211/183 |
| 7,028,852 | B2 | | 4/2006 | Johnson et al. | |
| 7,395,938 | B2 | * | 7/2008 | Merit et al. | 211/59.4 |
| 7,934,609 | B2 | * | 5/2011 | Alves et al. | 211/59.2 |
| 8,069,998 | B2 | * | 12/2011 | Thomas | 211/85.13 |
| 8,096,427 | B2 | * | 1/2012 | Hardy | 211/59.3 |
| 8,342,340 | B2 | * | 1/2013 | Rataiczak et al. | 211/59.3 |
| 2001/0002659 | A1 | | 6/2001 | Bada | |
| 2001/0010302 | A1 | | 8/2001 | Nickerson | |
| 2002/0108916 | A1 | | 8/2002 | Nickerson | |
| 2002/0170866 | A1 | | 11/2002 | Johnson et al. | |
| 2003/0057167 | A1 | | 3/2003 | Johnson et al. | |
| 2003/0085187 | A1 | | 5/2003 | Johnson et al. | |
| 2003/0141265 | A1 | | 7/2003 | Jo et al. | |
| 2003/0217980 | A1 | | 11/2003 | Johnson et al. | |
| 2004/0124161 | A1 | * | 7/2004 | Lau | 211/40 |
| 2005/0139560 | A1 | | 6/2005 | Whiteside et al. | |
| 2013/0020270 | A1 | * | 1/2013 | Valiulis et al. | 211/59.2 |

FOREIGN PATENT DOCUMENTS

| | | |
|---|---|---|
| EP | 270016 | 6/1988 |
| EP | 0 337 340 | 10/1989 |
| EP | 986980 | 3/2000 |
| FR | 2 526 338 | 5/1982 |
| FR | 2617385 | 1/1989 |
| FR | 2 724 098 | 3/1996 |
| GB | 2 027 339 | 2/1980 |
| GB | 2290077 | 12/1995 |
| JP | 59-218-113 | 12/1984 |
| WO | WO 02/091885 | 11/2002 |

* cited by examiner

MERCHANDISING SYSTEM

This application is a continuation-in-part of application Ser. No. 11/809,862 which was filed on Jun. 1, 2007 now U.S. Pat. No. 8,177,076. That application is, in turn, a continuation-in-part of application Ser. No. 11/356,398 which was filed on Feb. 16, 2006 and issued as U.S. Pat. No. 7,971,735 on Jul. 5, 2011.

FIELD OF THE DISCLOSURE

The present disclosure generally relates to adjustable shelving systems. More particularly, it is pertinent to an adjustable shelving system for storing and displaying merchandise of a variety of shapes and sizes, and urging such merchandise towards the front of a shelf. The shelving system is configured to organize merchandise on the shelf into rows.

BACKGROUND OF THE DISCLOSURE

Shelving is used extensively for stocking and storing products or merchandise in a variety of stores. Many stores simply employ shelves on which merchandise is stocked. In such stores, if the shelves are not at eye level, it is difficult for the customer to see the items being displayed, if they are not located adjacent the front edge of the shelf. It is desirable for merchandise to be displayed at the front of the shelf so that the customer can see the merchandise and be induced to purchase such merchandise. Also, such shelves make it difficult to rotate product, i.e., move the older stock to the front of the shelf and position newer stock behind the older stock. Rotating products is an important consideration, if the goods are perishable or are subject to becoming stale.

Numerous forward feed devices have been proposed to automatically move an item forward on a shelf, as the item before it is removed. These devices generally fall into one of three categories. The first category includes inclined tracks, which rely on gravity to feed, slide or roll products forward. A second category employs conveyor belts, which still use gravity to effect forward movement. A third category, which has become popular in recent years, uses spring biased paddles, in a pusher system to feed the product forward on a horizontally oriented shelf. Such pusher systems have been found useful for a variety of merchandise.

Forward feed devices are usually associated with divider walls. Normally, a divider wall is located on either side of a pusher, mounted on a track, (i.e., a pusher system), so as to maintain the merchandise in rows. In certain designs, both the pusher system and the divider wall are mounted to at least a front rail or front mounting member of the merchandising system, in order to allow a proper spacing of the pusher tracks and the divider walls on a shelf. In some known systems, the divider walls are separate from the pusher tracks. In others, the divider walls and the pusher tracks are of one piece. In either case, the divider walls and pusher tracks are, in some designs, slidably mounted on the front rail or mounting member. In other designs, one or both are fixedly mounted in relation to the front rail. In still other designs, both a front rail and a rear rail are employed and one or both of the pusher tracks and the divider walls are either fixedly secured to one or both of the front rail and the rear rail, or slidably mounted thereon.

Problems remain, however, with both the forward feed devices and the divider walls. As to the forward feed devices, almost universally today these are made from some type of plastic in an injection molding operation. However, the moldings are fairly complex and, thus, the die to make them is complicated and expensive. It would be desirable to develop a track of a simple design which would be easier to mold and yet have sufficient rigidity to resist the stresses and strains imposed on the track during use. With regard to the divider walls, these are normally of a single width. That width, however, may be too wide for certain thin merchandise items offered for sale, such as a column of tooth brushes or small bottles of paint for model kits, such as cars, airplanes, boats and the like.

Another difficulty with forward feed devices is that the current devices are not adapted for use in connection with wide products, such as frozen food packages sold in grocery stores or the like. Moreover, the current designs of dividers and tracks do not allow such dividers or tracks to be selectively locked to a mounting member, such as a front rail, or movable in relation to the mounting member. Nor are the current dividers and tracks provided with resiliently biased engaging elements for engaging a suitably shaped portion of the mounting member. It would be advantageous to have dividers and tracks that can be selectively locked to the mounting member or movable in relation thereto, via the simple engagement and disengagement of locking elements which are accessible from the front of the shelf. In this way, if it is desired to shift the divider or the track laterally in relation to the rail, the locking element can be disengaged and the divider or track can be shifted. It is particularly advantageous to be able to move the track without having to unload the products being held on the track, before the track can be moved.

Unloading of the products held on the track is greatly disadvantageous from the standpoint that it makes the shifting of the track along the rail a time consuming chore for store personnel. It should be appreciated that with the weight of the products on the track, it is quite difficult for store personnel to move the track laterally. This is due to the friction generated between the track and the shelf supporting it during any attempt to move the track because of the weight of product, when coupled with any locking feature of the track.

Therefore, it would be beneficial to store personnel if they could move a track (or a divider, or both) in a selective fashion without having to remove all the products which are held on the track. At the same time, it is beneficial to positively lock either the divider or the track, or both, to the rail when merchandise has been correctly loaded on the track, usually in a column, and the dividers are adequately spaced apart to accommodate the merchandise. In other words, it is desirable to prevent inadvertent movement of at least the dividers, if not also the tracks, during normal shopping activity by consumers. Dividers in particular are sometimes shifted sideways when round containers are pushed forward on tracks. It is said that the dividers "walk." It is desirable to retard or prevent such movement. However, it is also advantageous to allow store personnel to adjust the locations of at least the tracks, if not also the dividers, on a rail without being forced to unload the tracks before being able to move them.

Accordingly, it has been considered desirable to develop a new and improved merchandising system which would overcome the foregoing difficulties and others, while providing better and more advantageous overall results.

SUMMARY OF THE DISCLOSURE

According to one aspect of the present disclosure, a merchandising system comprises an elongated mounting member selectively securable to a front portion of an associated shelf. A cooperating member is received on the mounting member. The cooperating member extends rearwardly over the associated shelf. The cooperating member comprises an elongated body including a front end and a rear end. A nose extends from the front end. A hinge connects the nose to the front end. The nose contacts a wall of the elongated mounting member to retard relative movement between the cooperating member and the elongated mounting member.

According to another aspect of the present disclosure, a merchandising assembly is provided. The merchandising assembly comprises a one piece track comprising an elongated body. The track comprises a head portion located at a forward end of the body and a nose protruding from the head portion. A living hinge movably mounts the nose to the head portion. A rail extends from the body. A pusher is selectively mounted on the body so as to engage the rail, wherein the pusher is movable in relation to the track.

According to still another aspect of the present disclosure, a merchandising system for shelf is provided. In accordance with this aspect of the present disclosure, the system comprises an elongated mounting member selectively securable to a front portion of an associated shelf and a cooperating member selectively mounted to the mounting member. The cooperating member extends rearwardly over the associated shelf. The cooperating member comprises an elongated body, including first and second side edges. A groove extends in the elongated body from the first side edge to the second side edge thereof. A nose protrudes from the elongated body. The groove separates the nose from a remainder of the elongated body allowing the nose to flex in relation to the remainder of the elongated body.

BRIEF DESCRIPTION OF THE DRAWINGS

The present disclosure may take form in certain parts and arrangements of parts, several embodiments of which will be described in detail in this specification and illustrated in the accompanying drawings which form a part hereof and wherein.

DETAILED DESCRIPTION OF THE PREFERRED EMBODIMENTS

Figure 1:
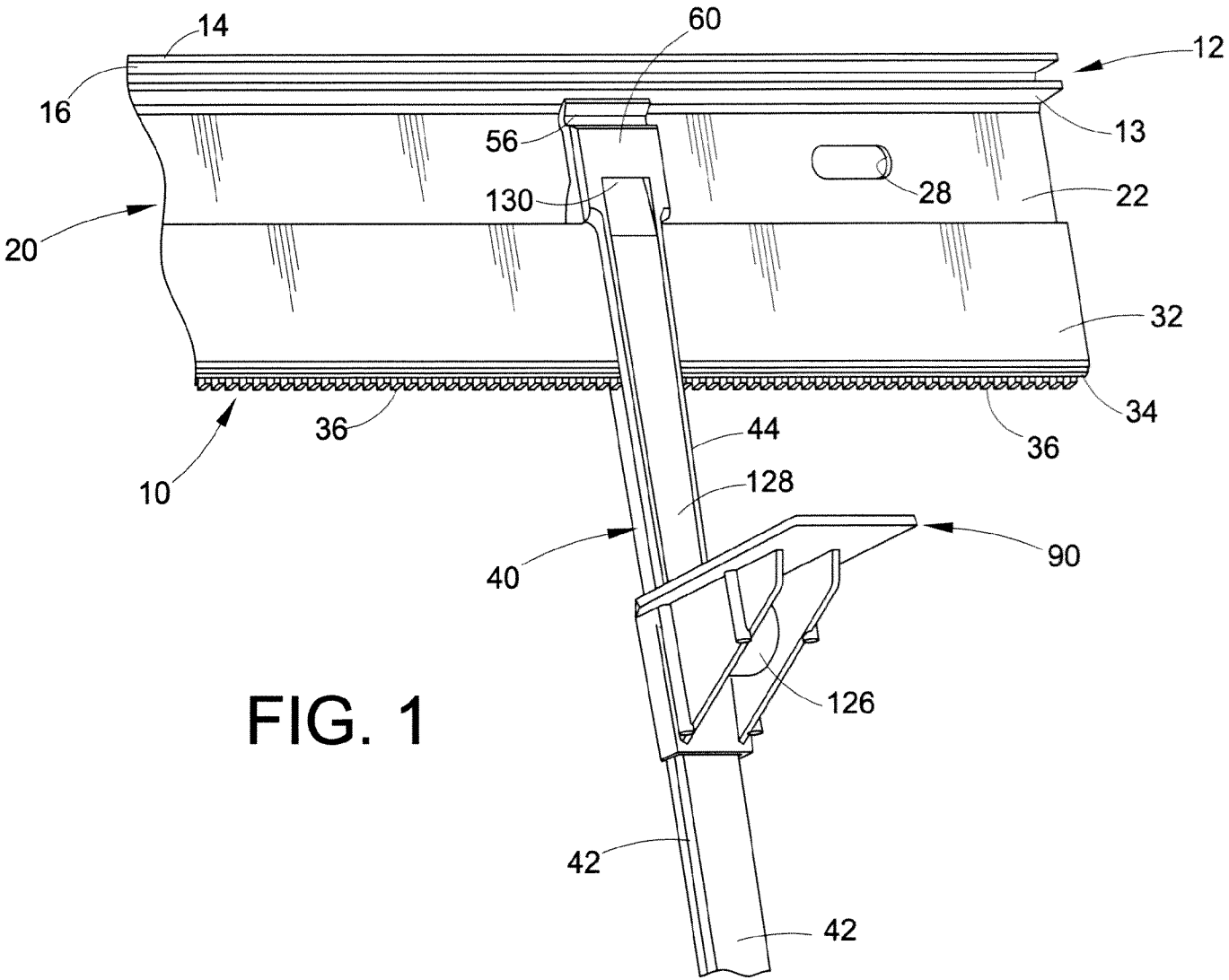
FIG. 1 is a rear perspective view of a merchandising system including a track mounted on a front rail, in accordance with a first embodiment of the present disclosure.

Referring now to the drawings, wherein the showings are for purposes of illustrating several preferred embodiments of the disclosure only, and not for purposes of limiting same, FIG. 1 illustrates a first embodiment of a merchandising system according to the present disclosure. In this embodiment, an elongated mounting member or front rail 10 includes a vertically oriented wall 12, which comprises a first section 14, a groove 16 and a second section 18. Also provided on the mounting member 10 is a horizontally oriented wall 20. Disposed in the horizontally oriented wall is a second groove 22. An aperture 28, positioned in the second groove 22, extends through the horizontally oriented wall 20. A suitable conventional fastener (not illustrated) can extend through the opening 28 so as to secure the mounting member in place on a subjacent shelf (not illustrated). Such a construction is shown in applicant's previously filed application Ser. No. 10/686,096 which is dated Oct. 14, 2003. That application is incorporated herein by reference, in its entirety. Moreover, applicant has also filed a related case, application Ser. No. 10/854,991 which is dated May 27, 2004. That application is also incorporated herein by reference, in its entirety.

As mentioned, the horizontally oriented wall 20 comprises the second groove 22, and a plateau-like section which includes a front face 30, a top face 32 and a back face 34. Located on the back face are a plurality of spaced teeth 36.

Figure 8:
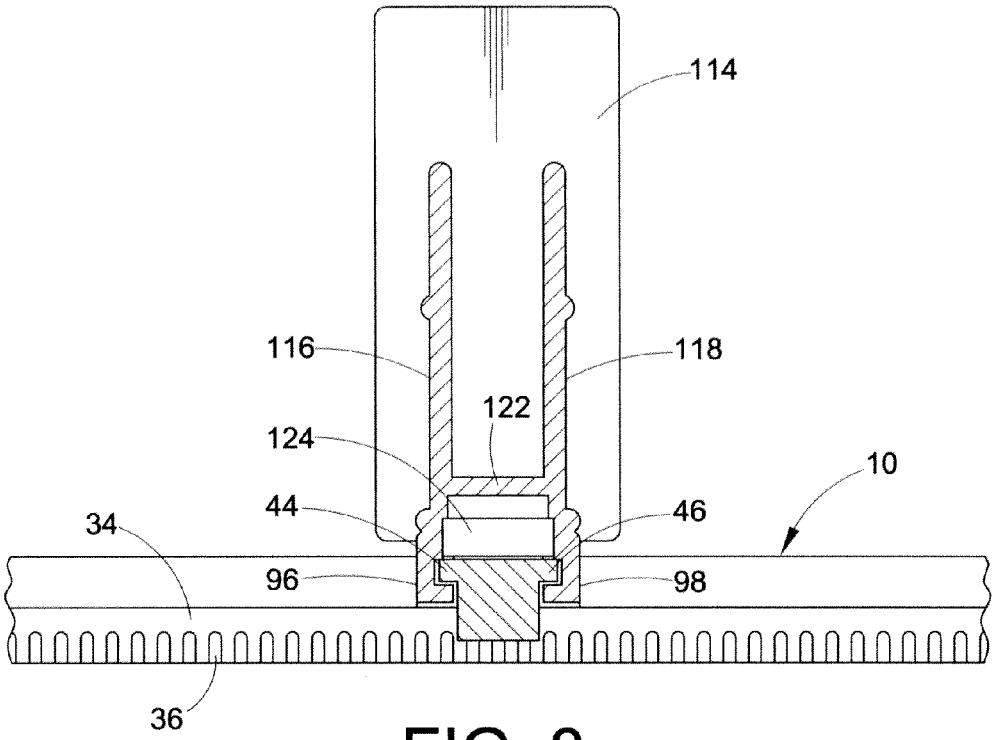
FIG. 8 is a rear elevational view, in partial cross section, of the merchandising system of FIG. 1.

A cooperating member, such as a pusher track 40 is selectively mounted on the front rail 10. The track 40 includes an elongated track body 42. Defined on the track body in this embodiment are a pair of oppositely extending rails 44 and 46. As is evident from FIG. 8, the track body 42 is solid in cross section. As can also be seen from the cross sectional view of FIG. 9, the track is solid in longitudinal section, along a longitudinal axis thereof. Having a solid rail is advantageous for a number of reasons. First, it makes the molding process for making the rail—from a suitable known thermoplastic material—easier than molding conventional tracks, which require a more complicated die. In addition, because the track is solid, rather than being hollow with cross braces, it can be made from a less expensive thermoplastic material than used for conventional tracks. Conventional track designs require a more rigid and hence more expensive thermoplastic material.

If desired, the track can be made via a gas-assisted injection molding process, in which a certain proportion of the thermoplastic material of the track is replaced by gas. Since less material is used, the cost of the track is reduced somewhat. Such a process allows the part to be somewhat lighter, while still preserving its inherent strength. With this design, the track also has a relatively lower coefficient of friction. The coefficient of friction of such a track is reduced somewhat because of the more porous track surface resulting from the gas-assisted injection molding process. With a more porous surface, there is less surface contact between the track on the one hand and merchandise or a pusher paddle on the other hand. Thus, merchandise supported by the track can more easily slide on the track, as can a pusher paddle.

Figure 3:
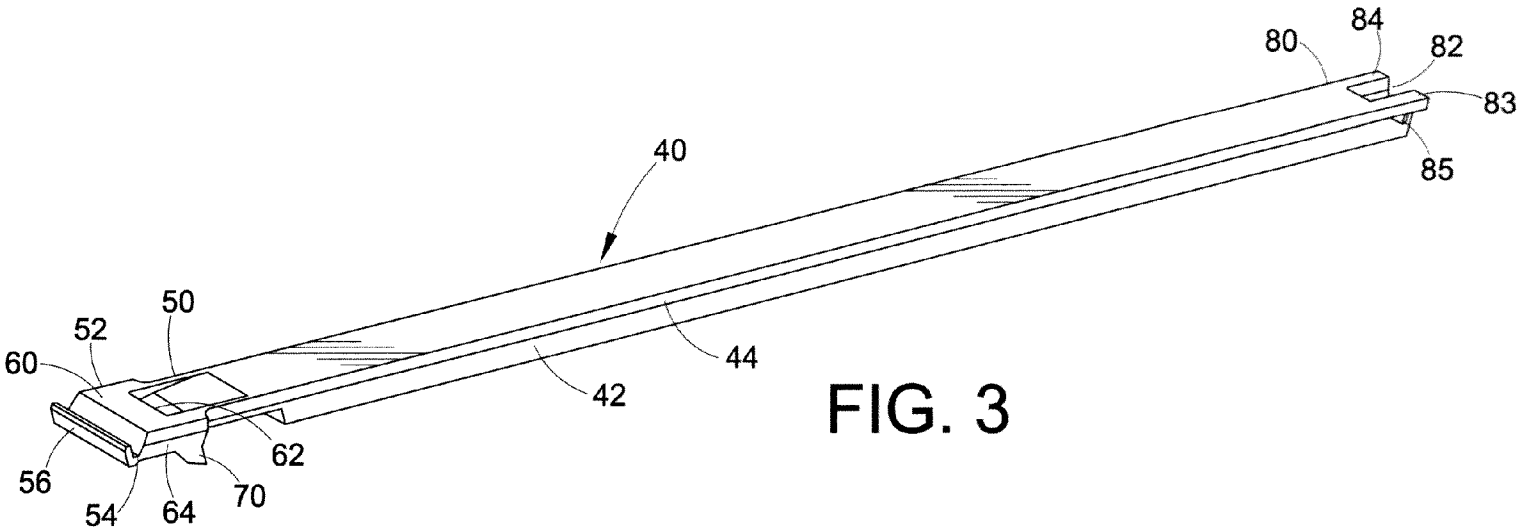
FIG. 3 is a top side perspective view of the track of FIG. 1.

With reference now to FIG. 3, the track includes a front end 50, which comprises a mounting head 52. The mounting head includes a front face 54. Protruding from the front face is a forwardly extending lip 56. As best seen in FIG. 1, the lip 56 is meant to engage the second section 18 of the front rail vertically oriented wall so as to correctly locate or position the track on the front rail and prevent any looseness or wobbling in the engagement between the track and the front rail.

Figure 2:
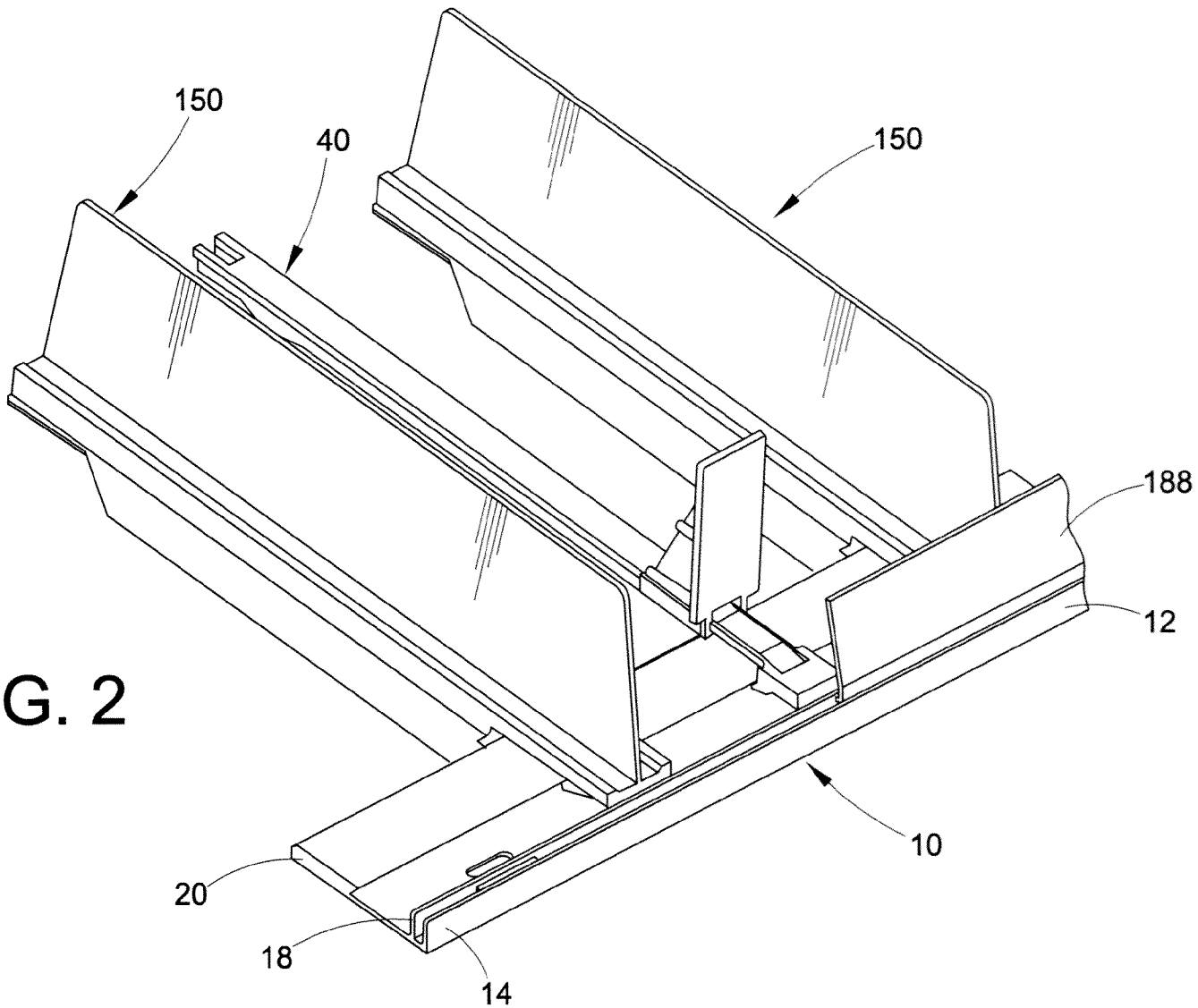
FIG. 2 is a reduced front perspective view of the merchandising system of FIG. 1, also including a pair of dividers and a front fence.
Figure 4:
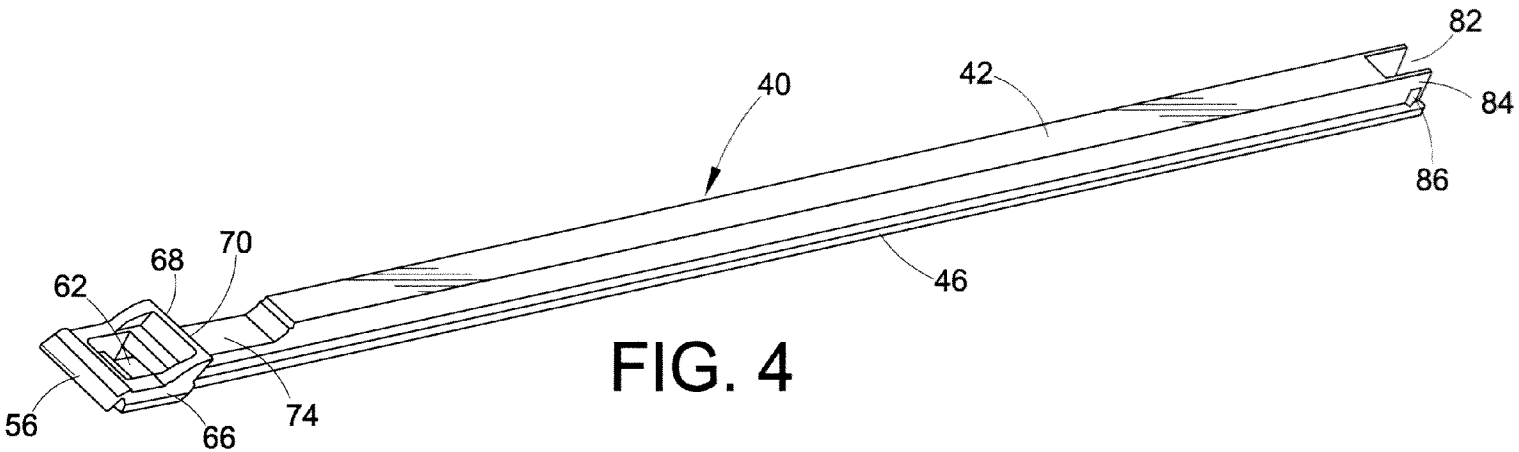
FIG. 4 is a bottom side perspective view of the track of FIG. 1.

The mounting head 52 also includes a top face 60. An aperture 62 extends through the top face, as is evident from a comparison of FIGS. 3 and 4. The mounting head also includes a first side wall 64, a second side wall 66 and a rear wall 68. Depending from the rear wall is a projection 70. Located in the pusher track 40 behind the mounting head 52 is a cross slot 74, as best seen in FIG. 4. The cross slot is meant to accommodate the plateau-like portion of the front rail, as is evident from FIGS. 1 and 2.

With reference again to FIG. 3, the pusher track includes a rear end 80. Extending through the rear end is a vertically oriented slot 82. The slot 82 thus divides the track rear end into two portions or defines extensions 83 and 84. Such extensions allow the track rear end to be flexible, in relation to the remainder of the track. Located on opposed side faces of the track body 42, adjacent the slot 82, are first and second teeth 85 and 86. The teeth can be located directly beneath the first and second rails 44 and 46.

Figure 6:
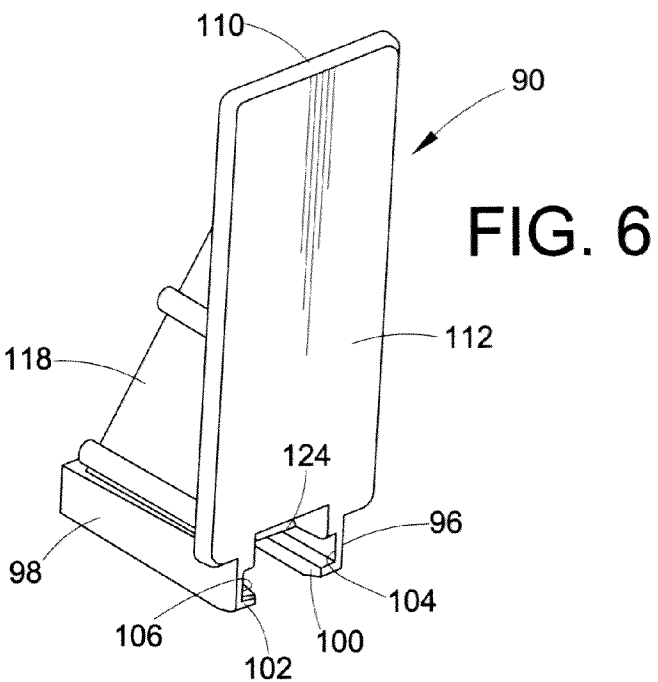
FIG. 6 is a front perspective view of the pusher of FIG. 5.
Figure 5:
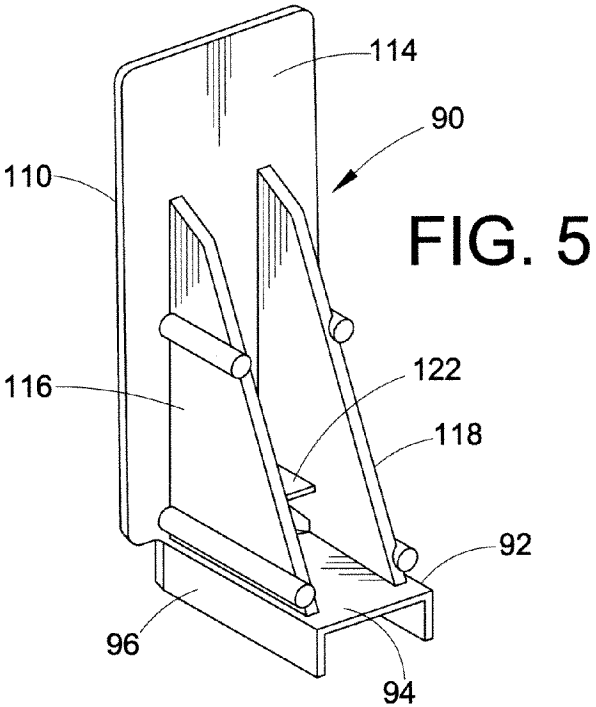
FIG. 5 is an enlarged rear perspective view of a pusher mounted on the track of FIG. 1.
Figure 7:
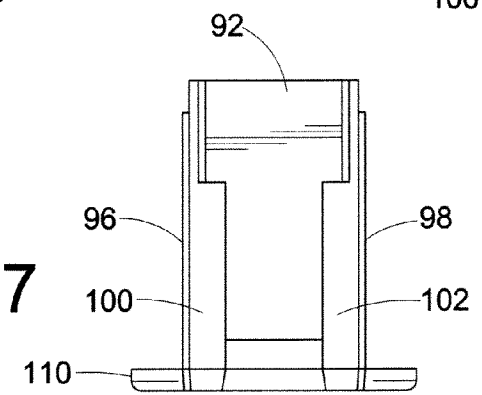
FIG. 7 is a reduced bottom plan view of the pusher of FIG. 5.

With reference now to FIG. 5, a pusher 90 is adapted to be mounted on the pusher track 40. The pusher 90 includes a base 92. The base comprises a top wall 94, a first side wall 96 and a second side wall 98 (FIG. 6). Thus, an inverted channel-like configuration is defined. With reference now also to FIG. 7, a first flange 100 extends from the first side wall 96 and a second flange 102 extends from the second side wall 98. With reference to FIG. 6, a first groove 104 is defined in the first side wall 96 and the second groove 106 is defined in the second side wall.

Figure 9:
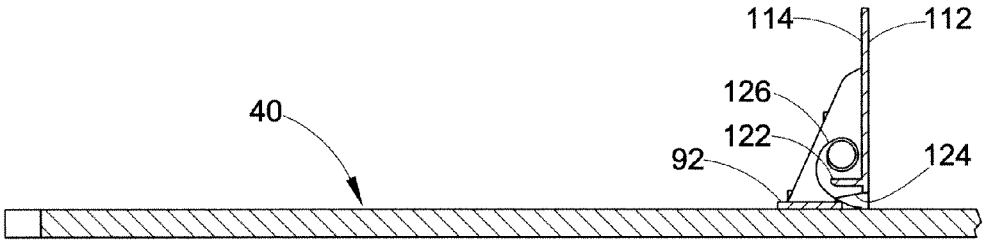
FIG. 9 is a reduced side elevational view, in cross section, of the merchandising system of FIG. 1.

A paddle 110 is mounted on the base 92. FIG. 6 shows that the paddle includes a front face 112. With reference again to FIG. 5, the paddle also includes a rear face 114. Supporting the rear face are first and second gussets 116 and 118, which extend from the paddle rear face to the base top wall 94. The gussets reinforce the pusher 90 and prevent the paddle 110 from buckling. A support wall 122 is disposed between the pair of gussets, in a manner spaced from the pusher base top wall 94. With reference now to FIG. 9, a suitable coil spring 126 is mounted on the support wall 122. As best shown in FIG. 1, the coil spring has a front portion 128 and a front end 130. The coil spring front end includes a bent portion (not visible) which extends into the aperture 62 in the pusher track and engages the track to retain the spring in place. This is conventional in the art.

When merchandise (not illustrated) is placed on the track 40 as in FIG. 1, the merchandise sits on the forward portion 128 of the coil spring. The spring, since it is made from a suitable conventional metal, is inherently somewhat more slippery than the material of the track. Since the coil spring sits directly on the track, the merchandise sits on the coil spring and, thus, can slide more easily than if it sat directly on the track. In another embodiment, ribs (not shown) could be provided laterally on both sides of the coil spring so as to further reduce frictional contact between the track and merchandise supported on the track.

In order to mount the pusher 90 on the pusher track 40, the two portions or extensions 83 and 84 of the track body rear end 80 are pushed towards each other. Due to the resilient and flexible nature of the thermoplastic material from which the track body is made, and due to the presence of the vertical slot 82, a width of the track rear end can be reduced so as to allow the pusher base to be mounted on the pusher track. Once the pusher is mounted, the rear end portions 83 and 84 return to their normal orientation because of the inherent resiliency of the material from which the track is made. When so mounted, the first and second rails 44 and 46 of the pusher track are accommodated in the first and second grooves 104 and 106 defined in the base 92 of the pusher 90. Therefore, the pusher 90 is allowed to reciprocate on the track 40. Also, the pusher is urged in a forward direction by the coil spring 126.

The teeth 85 and 86 at the rear end of the pusher track 40 prevent the pusher 90 from sliding off the track at the rear end thereof. More particularly, the side walls 96 and 98 of the pusher engage the teeth 85 and 86 to prevent the pusher from being slid off the track. However, in case the pusher needs to be removed, a merchant simply needs to press the two portions 83 and 84 of the track rear end towards each other so as to allow the pusher to clear the teeth. In order to prevent the pusher from sliding off the forward end of the track, it is apparent from, e.g., FIG. 1, that the pusher track mounting head 52 is larger in width than is the remainder of the pusher track. This serves several purposes.

First, it prevents the pusher from sliding off the track in a forward direction. Secondly, the wider mounting head 52 on the pusher track 40 prevents engagement between adjacent pushers mounted on adjacent tracks. Such engagement is disadvantageous as it would retard the ability of the pusher to slide forward and rearward on the track. Thus, the relative width of the mounting head 60 is such that it is at least as wide as a cross section taken through the pusher track and the pusher, at the location of the pusher 90. This cross sectional relationship prevents the pusher from getting hung up on an adjacent pusher track or being inadvertently moved, when it is located next to another pusher on an adjacent pusher track.

With reference again to FIG. 2, a divider 150 according to one embodiment of the present disclosure includes a base 152 and an upright wall 154 protruding from the base. The upright wall can separate the base into a first section 156 and a second section 158. Located adjacent a front end of the base is a projection 172. Located rearwardly of the projection is a cross slot 174. The cross slot is meant to accommodate the plateau-like raised section of the front rail horizontally oriented wall. In this embodiment, a side wing 180 is located on one side of the base 152. For narrow products, such as, e.g., a row of tooth brushes, the wing 180 can be broken off from the divider base along a break line or weakened line 182. In this way, the divider can be made narrower when that is necessary. It should be apparent that the break line 182 can extend parallel to a longitudinal axis of the divider 150. A front fence 188 can be inserted in the slot 16 located between the first and second sections 14 and 18 of the front rail vertical wall 12. The front fence can be made from a transparent material, so that the merchandise being displayed on the shelf (not illustrated) is visible to the customer.

Figure 10:
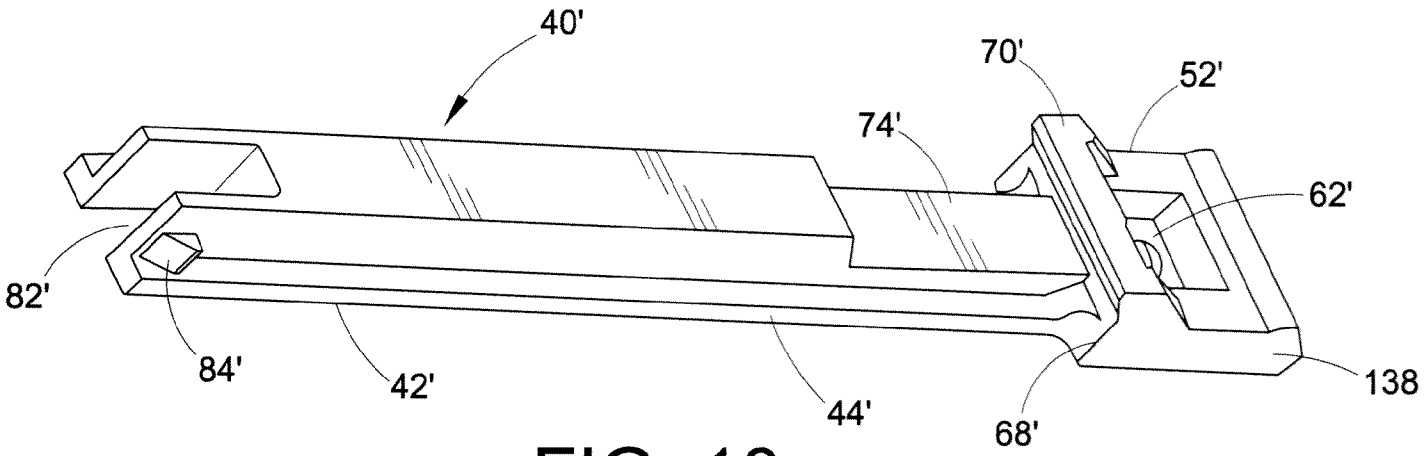
FIG. 10 is a rear perspective view of a front rail according to a second embodiment of the present invention.

With reference now to FIG. 10, a second embodiment of the merchandising system according to the instant disclosure includes an elongated mounting member, such as a front rail 210, which includes a vertically oriented wall 212, which, in turn, comprises a first section 214, a groove 216 and a second section 218. A front fence 219 can be mounted in the groove 216. Also provided on the front rail or mounting member 210 is a horizontally oriented wall 220. Disposed in the horizontally oriented wall is a second groove 222. An aperture 228 is positioned in the second groove 222, and extends through the horizontally oriented wall 220. A suitable conventional fastener (not illustrated) can extend through the opening 228 so as to secure the front rail in place on a shelf. The horizontally oriented wall 220 also comprises a plateau-like section 224 which includes a front face 230, a top face 232 and a back face 234. Located on the back face are a plurality of spaced protrusions, which can be teeth 236.

Figure 11:
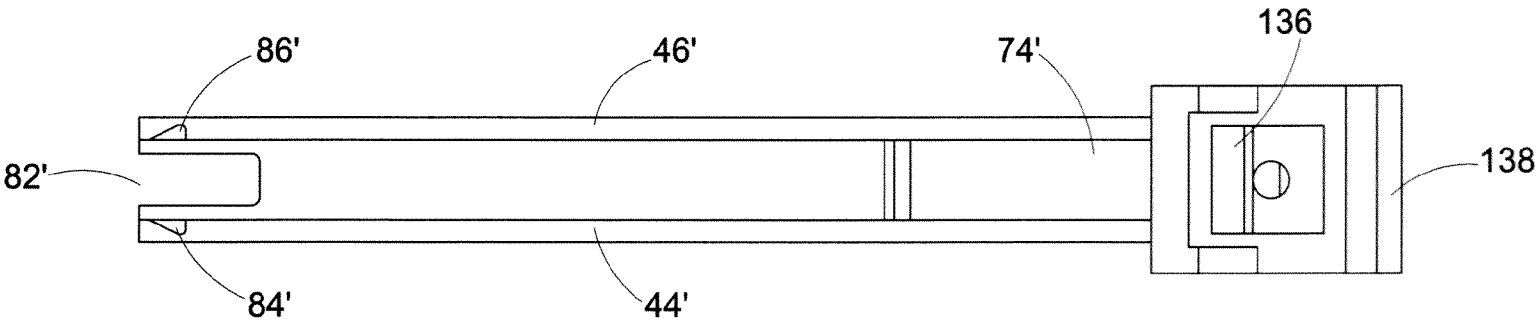
FIG. 11 is a rear perspective view of a short track which can be accommodated on the front rail of FIG. 10.
Figure 12:
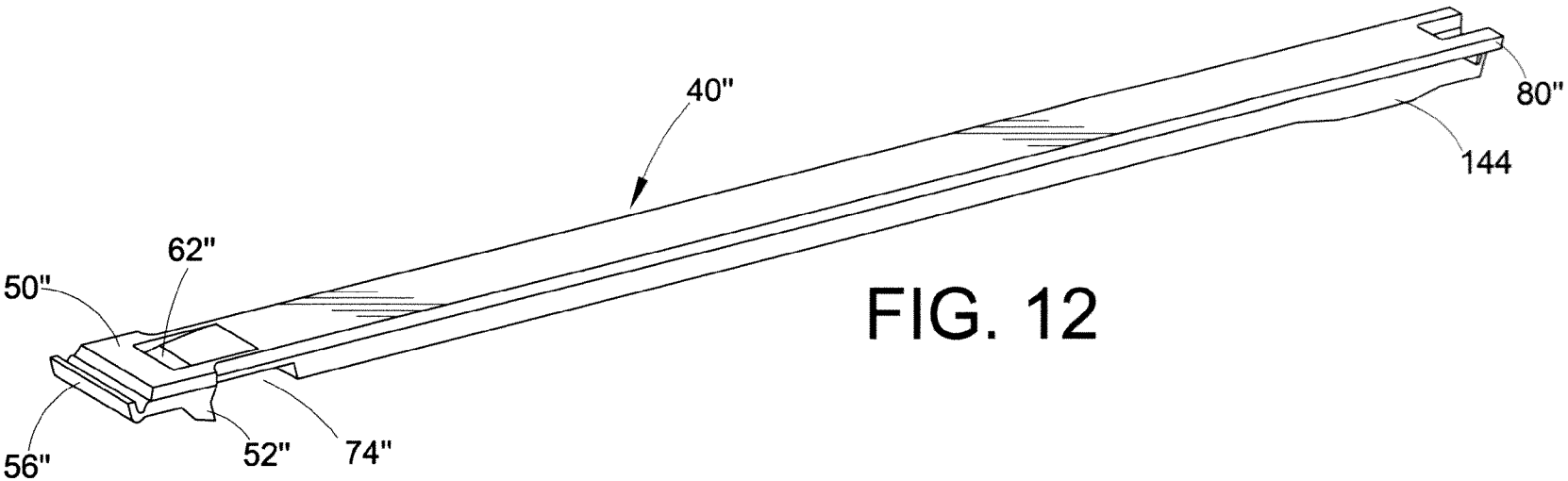
FIG. 12 is a bottom perspective view of an elongated track which can be accommodated on the front rail of FIG. 10.

With reference now also to FIG. 11, a cooperating member, such as a pusher track 240 is selectively mounted on or to the front rail 210. As best shown in FIG. 12, the track 240 can include an elongated track body 242, of any desired length. Defined thereon are a pair of oppositely extending rails 244 and 246. The track also includes a recessed central section 248, as can best be seen in FIG. 11. Such recessed area 248 is defined in a horizontal wall 250 of the track 240.

With reference now to FIG. 12, depending from the horizontal wall 250 are first, second, third and fourth reinforcing ribs 252-258. As is evident, the four reinforcing ribs are spaced from each other. Extending between the two inner reinforcing ribs 254 and 256 are a series of stiffening elements 260. These can be arranged in zigzag fashion, in order to provide additional strength or stiffness to the track 240. However, grooves (unnumbered) are defined between the first and second stiffening ribs 252 and 254, as well as between the third and fourth stiffening ribs 256 and 258. In other words, no stiffening elements are located in these grooves. In this embodiment, the track 240 can be injection molded from a suitable known material, such as a thermoplastic material.

The track also includes a front end 270 which extends forward of the reinforcing ribs 252-258, as well as the stiffening elements 260. Protruding from the front end 270 is a tongue 272. As in the embodiment illustrated in FIGS. 1-9, the tongue 272 contacts the rail vertically oriented wall second section 218 in order to correctly align the track with the rail and in order to prevent any looseness or wobbling of the track in relation to the rail. Defined on a bottom side of the track is a traverse slot 274. The slot is defined on a front side by a pair of depending flanges 276 and 278, separated by a gap 280. It is defined on a rear side by a wall 282 which serves as the forward terminus of the four stiffening ribs 254-258.

A respective tooth 284 can be located at a rear end of each of the rails 244 and 246. Only one of the teeth is visible in FIG. 12. The purpose for the teeth is to prevent a pusher 290 from being retracted so far that it falls off the track. To this end, the pusher 290 includes a base 292 which will contact the teeth 284. With reference again to FIG. 11, the base 292 includes a top wall 294 which can be recessed so as to be correctly accommodated on the track 240. The base also includes first and second sidewalls 296 and 298, as well as respective flanges extending inwardly therefrom. Only one such flange 300 is visible in FIG. 11. In other words, the base 292 wraps around the rails 244 and 246 located on the track 240.

Figure 13:
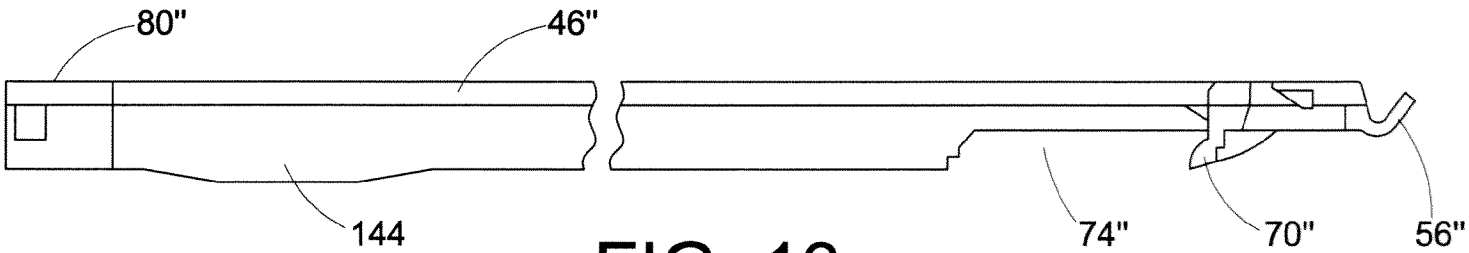
FIG. 13 is a side elevational view of the track of FIG. 11 assembled on the front rail of FIG. 10.

Supported on the base is a paddle 310. Included on the paddle is a front face 312 (FIG. 13) and a rear face 314 (FIG. 11). Unlike the paddle embodiment illustrated in FIG. 8, the paddle 310 shown in FIG. 11 is considerably wider than is the width of its track 240. For example, the paddle can be approximately twice as wide as the track. In this way, the paddle can accommodate wide merchandise, such as, for example, frozen TV dinners or the like. Of course, it should be appreciated that the paddle can have any desired shape and width depending upon the merchandise which is meant to be urged forwardly on the track. Supporting the rear face are a plurality of gussets 316. Since a wide paddle 310 is illustrated in this embodiment, the plurality of gussets are so arranged that the two outermost gussets are angled outwardly in order to better support the paddle 310 on the base 292. Disposed between the inner two gussets is a coil spring 318. As is well known in the art, the coil spring will bias the pusher 290 forwardly on the track 240.

With reference now again to FIG. 13, when the track 240 is assembled on the front rail 210, the pair of spaced flanges 276 and 278 will contact the front face 230 of the plateau-like section 224 and the slot 274 on the track 240 accommodates the plateau-like section. However, the forward wall 282 of the track is spaced from the teeth 236 defined on the back face 234 of the plateau-like section 224 so as to not interfere therewith. In addition, the forwardly extending lip 272 defined on the front end 270 of the track 240 will contact the second section 218 of the vertically oriented wall 212 of the front rail 210. However, this contact will be above the second groove 222 which is defined in the front rail 210.

With this arrangement, the track 240 is slidable laterally or sideways in relation to the track 210. However, disengagement of the track from the front rail can be achieved without having to slide the track sideways until it is detached from the front rail. Instead, one can twist the track about its longitudinal axis in a first direction such that a first one of the flanges 276 and 278 is disengaged from its contact with the plateau-like section 224 and then twist it in an opposite, second direction until the other flange is disengaged. This can be accomplished due to the inherent resiliency of the thermoplastic material from which the track 240 is made. Also, the front rail 210 can be made from a similar thermoplastic material, so that both the front rail and the track can have some "give".

Figure 14:
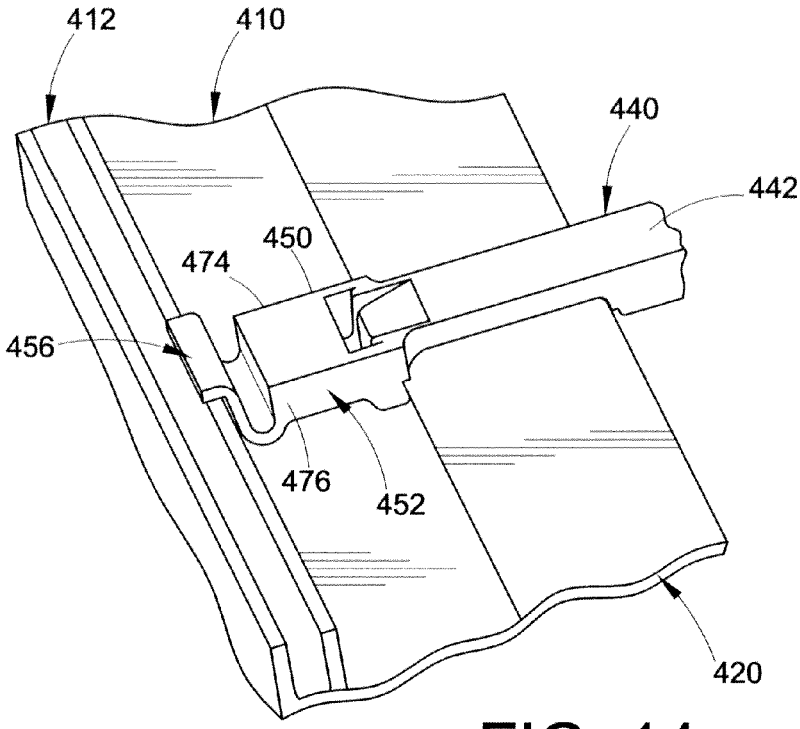
FIG. 14 is a perspective view of a cooperating member which selectively engages a front rail according to another embodiment of the present disclosure.
Figure 15:
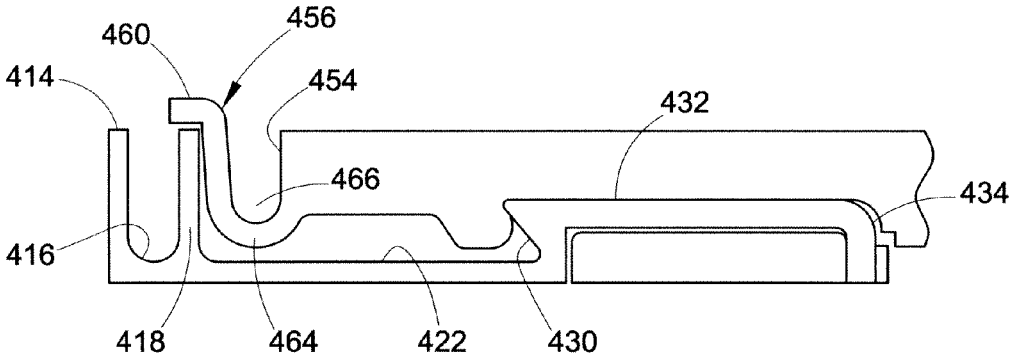
FIG. 15 is an enlarged side elevational view of the cooperating member and front rail of FIG. 14; and, FIG. 16 is a rear perspective view of the cooperating member and front rail of FIG. 14 with a pusher slidably mounted on the cooperating member.

With reference now to FIG. 14, another embodiment of a merchandising system according to the present disclosure is there illustrated. In this embodiment, an elongated mounting member or front rail 410 includes a vertically oriented wall 412 which comprises a first section 414, a groove 416 and a second section 418 (FIG. 15). Also provided on the mounting member 410 is a horizontally oriented wall 420. Disposed in the horizontally oriented wall is a second groove 422. The horizontally oriented wall 420 also comprises a plateau-like flat section 426 which includes a front face 430, a top face 432 and a back face 434.

A cooperating member, such as a pusher track 440, is selectively mounted on the front rail 410. The track 440 includes an elongated body 442. The track includes a front end 450 which comprises a mounting head 452. The mounting head includes a front face 454. Protruding from the front face is a nose section 456. The nose section 456 is meant to selectively engage the second section 418 of the front rail vertically oriented wall so as to correctly locate or position the track in relation to the front rail and to prevent any looseness or wobbling in the engagement between the track and the front rail. In this embodiment, the nose section is provided with a lip 460. The lip is oriented generally perpendicularly to a vertical plane and is oriented at an obtuse angle in relation to a plane in which the nose 456 extends. In this embodiment, a hinge 464, such as a living hinge, connects the nose 456 to the mounting head 452 of the track 440. Helping define the hinge is a generally U-shaped channel 466 which extends between opposed first and second side edges 474 and 476 of the track 440. The material from which the cooperating member is made can be a suitable thermoplastic which allows the hinge 464 to serve as a living hinge and allows the nose 456 to flex in relation to the remainder of the mounting head 452.

The design illustrated in FIG. 15 provides a large moment arm length, thereby enabling the greatest amount of deflection of the nose in relation to the track. It should be evident that the height of the nose 456 is greater than is the height of the mounting head front face 454. This allows for greater tolerance limits while minimizing stress in the flexible or spring-like nose. In one embodiment, this design can accommodate up to 0.040 inches of deflection without any creep by the thermoplastic material from which the one piece cooperating member can be made. With the design illustrated herein, the vertical front wall of the front rail, which can also be made from a suitable thermoplastic material as is known in the art, can deflect when the track 440 is removed. The lip 460 catches on a top surface of the second section 418 of the vertical wall of the front rail for this purpose. The track or cooperating member 440 can be selectively mounted on the front rail 410 as in the embodiments discussed above. It should be appreciated from FIG. 15 that the nose can be connected by the hinge to the elongated body front end adjacent a bottom surface of the elongated body such that the nose is spaced from a top surface of the elongated body by the width of the channel 466. In one embodiment, the nose can be generally planar and is generally rectangular in shape. However, it should be appreciated that noses having other design configurations are also contemplated.

Figure 16:
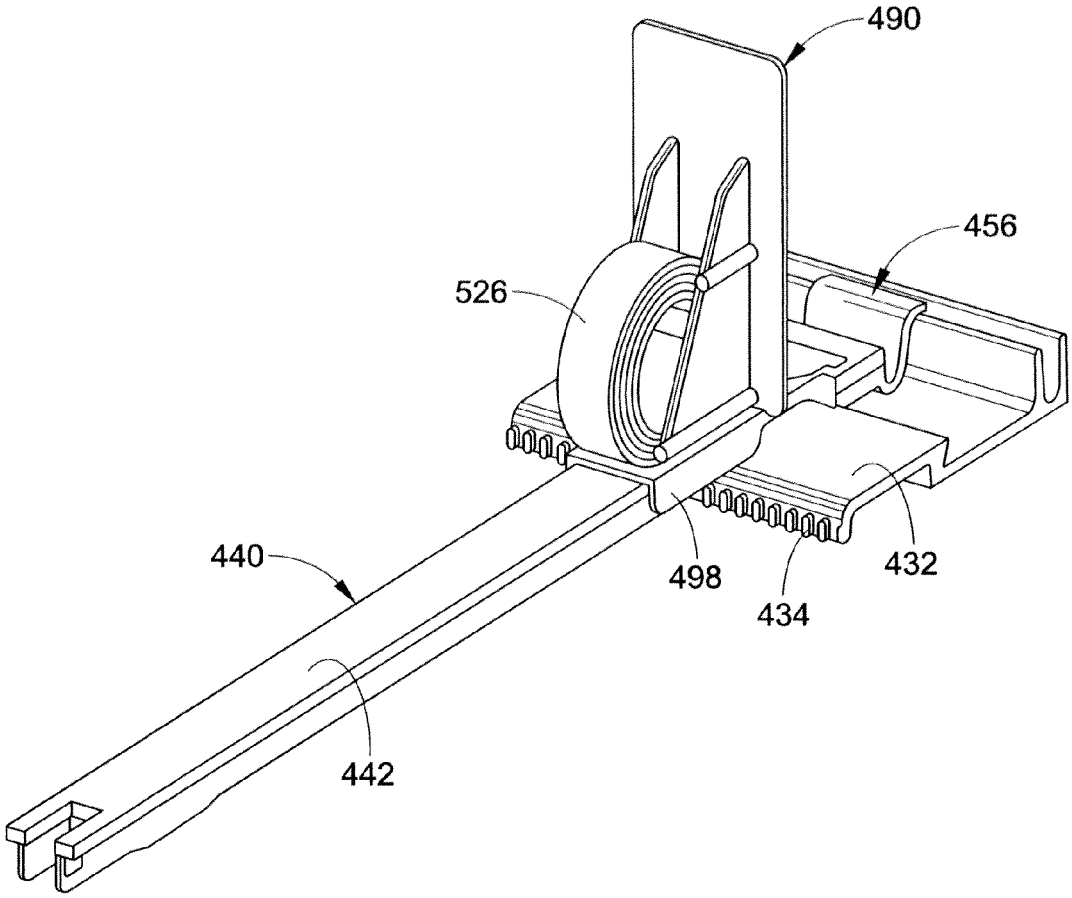

It should be appreciated from FIG. 15 that the lip 460 has a length not much greater than the width of the top surface of the second section 418. In other words, the groove 416 needs to be left open as it needs to accommodate a front fence, along the lines of the fence 188 illustrated in FIG. 2 herein. With reference now to FIG. 16, it should be apparent that the track 440 includes at least one rail 442 for engaging a suitable section 498 of a pusher 490. Mounted on the pusher and the disposed between a pair of gussets is a suitable coil spring 526. The coil spring has a front end which engages the pusher track as is conventional in the art, whereas the coiled portion of the spring is accommodated on a base of the pusher.

While the embodiments disclosed in FIGS. 14-16 relate to the provision of a nose on a track, it should be appreciated that the cooperating member could instead be a divider or a combination divider and track assembly, if so desired. For example, the nose or resilient lip could be disposed at the front end of a divider which is selectively mounted to the rail or mounting member. Similarly, the nose section could be provided on the front face of an upside down T-shaped combination divider and track assembly in which the track is disposed on a base that also supports a divider.

The provision of a lip, such as lip 460 at the free end of the nose section, would be beneficial not only for tracks, but also for dividers or combination divider and track assemblies. For each of these types of cooperating members, the disclosed nose section and lip would maximize the moment arm length to provide the greatest amount of deflection for the front rail when the cooperating member is removed from the front rail. This eases the installation and removal of the cooperating member in relation to the front rail, while at the same time providing a solid contact between the cooperating member and front rail to retard relative movement between the cooperating member and the front rail when the two are engaged.

The disclosure has been described with reference to several embodiments. Obviously, modifications and alterations will occur to others upon a reading and understanding of this specification. It is intended to include all such modifications and alterations in so far as they come within the scope of the appended claims or the equivalents thereof.

We claim:

1. A merchandising system comprising:

an elongated mounting member selectively securable to an associated shelf having first and second side edges, wherein the mounting member has a length generally equal to a distance between the first and second side edges of the associated shelf so that a single mounting member extends between the first and second side edges of the associated shelf, when the mounting member is secured to the shelf;

a cooperating member received on the mounting member, wherein the cooperating member extends rearwardly over the associated shelf, said cooperating member comprising:

an elongated body including a front end and a rear end, a nose extending from said front end, and a hinge connecting said nose to said front end, and wherein said nose contacts a wall of said elongated mounting member to retard relative movement between said cooperating member and said elongated mounting member.

2. The merchandising system of claim 1 wherein said cooperating member comprises an enlarged section.

3. The merchandising system of claim 2 wherein said enlarged section comprises a head portion of said cooperating member.

4. The merchandising system of claim 3, wherein said nose is generally planar and protrudes at an acute angle in relation to a front face of said head portion.

5. The merchandising system of claim 2 wherein said enlarged section comprises a thickened portion of said elongated body.

6. The merchandising system of claim 1 wherein said nose is connected by said hinge to said elongated body front end adjacent a bottom surface of said elongated body and wherein said nose is spaced from a top surface thereof.

7. The merchandising system of claim 1 wherein said nose comprises a lip which engages a generally horizontally oriented surface of said elongated mounting member.

8. The merchandising system of claim 1 wherein said hinge, nose and elongated body are of one piece.

9. The merchandising system of claim 1, wherein the nose is generally planar.

10. The merchandising system of claim 1, wherein the elongated mounting member includes a generally vertically oriented wall having a generally horizontally oriented top surface, the nose contacting the generally vertically oriented wall of the elongated mounting member.

11. A merchandising system comprising:

an elongated mounting member selectively securable to an associated shelf;

a cooperating member received on the mounting member, wherein the cooperating member extends rearwardly over the associated shelf, said cooperating member comprising:

an elongated body including a front end and a rear end, a nose extending from said front end, and a hinge connecting said nose to said front end, and wherein said nose contacts a wall of said elongated mounting member to retard relative movement between said cooperating member and said elongated mounting member;

wherein said cooperating member comprises a track and wherein said track comprises a vertically oriented slot located in said rear end of said elongated body such that said body defines a pair of extensions, making said rear end of said track flexible, to enable said pusher to be mounted on said track.

12. The merchandising system of claim 11 further comprising a pusher mounted on said track, said pusher comprising:

a base;

a pusher face extending from said base; and, wherein portions of said base engage said track to slidably mount said pusher on said track.

13. The merchandising system of claim 11 further comprising protrusions located on said side walls of said track adjacent said longitudinal slot to prevent said pusher from sliding off the track.

14. The merchandising system of claim 11, wherein said nose contacts a wall of the mounting member to retard relative movement between the mounting member and said cooperating member.

15. The merchandising system of claim 11, wherein the elongated mounting member includes a generally vertically oriented wall having a generally horizontally oriented top surface, the nose contacting the generally vertically oriented wall of the elongated mounting member.

16. The merchandising system of claim 11 wherein the nose comprises a lip which engages a surface of the track.

17. A merchandising system comprising:

an elongated mounting member selectively securable to an associated shelf;

a cooperating member received on the mounting member, wherein the cooperating member extends rearwardly over the associated shelf, said cooperating member comprising:

an elongated body including a front end and a rear end, a nose extending from said front end, and a hinge connecting said nose to said front end, and wherein said nose contacts a wall of said elongated mounting member to retard relative movement between said cooperating member and said elongated mounting member;

wherein the elongated mounting member includes a generally vertically oriented wall having a generally horizontally oriented top surface, the nose contacting at least one of the generally vertically oriented wall and the generally horizontally oriented top surface of the elongated mounting member.

18. The merchandising system of claim 17, further comprising a lip protruding from a free end of the nose, the lip contacting the generally horizontally oriented top surface of the elongated mounting member.

19. The merchandising system of claim 18, wherein a height of the nose is greater than a height of a front face of said head portion.

20. The merchandising system of claim 17 wherein the nose comprises a lip which contracts at least one of the generally vertically oriented wall and the generally horizontally oriented top surface of the elongated mounting member.

* * * * *